US006033081A

United States Patent [19]

Huang

[11] Patent Number: 6,033,081

[45] Date of Patent: Mar. 7, 2000

[54] LIGHTED TOOL

[76] Inventor: En Liung "Sunny" Huang, 786 Via Monte Video, Claremont, Calif. 91711

[21] Appl. No.: 09/072,761

[22] Filed: May 5, 1998

[51] Int. Cl.[7] ..... B25B 23/18

[52] U.S. Cl. ..... 362/119; 362/120; 362/202; 362/205

[58] Field of Search ..... 362/119, 120, 362/202, 205

[56] References Cited

U.S. PATENT DOCUMENTS

| | | | |
|---|---|---|---|
| 2,341,375 | 2/1944 | Hambleton . | |
| 2,521,251 | 9/1950 | Pettit . | |
| 3,373,737 | 3/1968 | Moore et al. . | |
| 3,590,232 | 6/1971 | Sadowski | 240/2 |
| 4,302,797 | 11/1981 | Cooper | 362/119 |
| 4,425,602 | 1/1984 | Lansing | 362/186 |
| 4,480,295 | 10/1984 | Shuster | 362/206 |
| 4,559,588 | 12/1985 | Engelson et al. | 362/196 |
| 4,819,135 | 4/1989 | Padilla et al. | 362/72 |
| 4,888,667 | 12/1989 | Hwang | 362/109 |
| 5,211,468 | 5/1993 | Jeng | 362/120 |
| 5,448,459 | 9/1995 | Rogers | 362/191 |
| 5,473,519 | 12/1995 | McCallops et al. | 362/120 |
| 5,515,249 | 5/1996 | Shiao | 362/119 |
| 5,584,564 | 12/1996 | Phyle | 362/102 |
| 5,628,556 | 5/1997 | Hrabar et al. | 362/119 |
| 5,826,968 | 10/1998 | Brantley | 362/119 |
| 5,845,986 | 12/1998 | Breen | 362/119 |

*Primary Examiner*—Cassandra Spyrou
*Assistant Examiner*—Leo Boutsikaris
*Attorney, Agent, or Firm*—Cislo&Thomas LLP

[57] ABSTRACT

A lighted tool for providing illumination to socket wrench sockets and the like. An adapter houses a battery-powered light source that may have a plurality of individual light sources. An extension projects inwardly into the adapter to mechanically engage the light. Flanges projecting outwardly from the extender are trapped between the adapter and a threaded ring that threads upon the adapter to trap the flanges, and therefore the extender, between the threaded ring and the adapter. The light may be illuminated by either compressing the light as by tightening the threaded ring or by a separate switch. Upon such compression, a spring- or other biased-contact may close the circuit to transmit the battery power to the lights. Furrows along the sides of the extender allow the light to transmit forwardly and to be projected upon and illuminate any tool held upon a forward projection of the extender and any nut, bolt, or other fastener head that is to be engaged by such a socket or other tool bit. In an alternative embodiment, the furrows are elongated to transmit the light forwardly along an extended sleeve. The light transmitted from the light sources held in the adapter are then more focused and less dispersed than for a shorter sleeve. In another alternative embodiment, an optic channel or fiber optic strand or cable is used to transmit the light from the light sources to the forward end of the extender, the socket or tool bit, and the fastener or other head or object.

24 Claims, 2 Drawing Sheets

R
R
40
40
40
46
46
46
60
62
64
64
64
70
74
72
22
78
80
20
24
90

30
32
34
100
104

LIGHTED TOOL

BACKGROUND OF THE INVENTION

1. Field of the Invention

This invention relates to hand tool accessories and more particularly to a socket wrench adapter that illuminates the nut or bolt operated on by the appropriate socket wrench.

2. Description of the Related Art

Wrenches provide mechanical advantage over a variety of fasteners such as bolts, nuts, and the like. The crescent wrench provides adjustable means by which a variety of different sizes of such nut or bolt heads may be turned, either fastening or unfastening the bolt or nut from a threaded counterpart.

As there are drawbacks in crescent wrenches coupled with the corresponding advantages of having the entire head addressed by the engaging portion, socket wrenches provide means by which hex nut heads and a variety of other head cuts may be subject to the mechanical extended leverage force of a lever or the like. Such socket wrench sets are readily available in the current American marketplace through a variety of retailers and wholesalers and often include ratchets to provide easier use and mechanical advantage.

One disadvantage to socket wrenches is that they provide no means by which the nut or bolt head can be illuminated or lit so that it is more easily viewed by the mechanic or other person wielding the tool. Prior attempts at the art have addressed this problem, but may have shortcomings that are more readily handled by the present invention.

It would be of significant advantage to provide a socket wrench and extender or the like that incorporated illumination means that not only did not interfere with the operation of the socket wrench, but also provided sufficient illumination so that the nut or bolt head could be illuminated for better working.

SUMMARY OF THE INVENTION

The present invention provides for a lighted tool via a socket wrench head extender that incorporates illumination or light means so that the nut or bolt head is more easily seen and made more easy to work with. In so providing the illuminating socket wrench extender, an adapter is provided that fits a standard or customized socket wrench head projection such as those found on socket wrench ratchets. The adapter also accommodates on an opposite side a light with battery holder. The light may have one or more light sources and the batteries are generally sufficiently small to fit within the confines of the adapter. Size is of consideration in the present invention as greater convenience is provided with smaller working parts. Smaller parts allow the tool to be used in smaller confines often found in conjunction with engines and the like.

The light may constructively engage a furrowed extender. The end of the furrowed extender adjoining the light may also fit within the confines of the light recess of the adapter. The furrows of the furrowed extender may be long or short depending upon the preference of the tool user and the demands of the job.

According to the length of the furrows, short or long sleeves, respectively, may be used to cover and disburse the light. For shorter sleeves, a threaded ring threadingly engages the adapter to hold the light in place with respect to the adapter and the furrowed extender. Flanges projecting outwardly from portions of the furrowed extender adjacent the light may flare outwardly to constructively engage the adapter and prevent displacement of the furrowed extender with respect to the adapter. The short sleeve may have a translucent light-dispensing panel to disperse the light transmitted from the light sources so that better illumination of the nut or bolt head is made.

For a long furrowed extender, a longer sleeve may be used in conjunction therewith also having a threaded ring portion threadingly engaging the adapter in a manner similar to that of the shorter ring. Optic channels such as those provided by fiber optics or the like may run the length of a longer sleeve to deliver the light from the light source further along the length of the furrowed extender and to bring the light closer to the nut or bolt head upon which work is to be made.

The embodiments shown in the drawing figures and described herein are not limited to those so disclosed. Different configurations of socket wrenches or the like may provide easily-facilitated alternative embodiments falling within the scope of the present invention.

OBJECTS OF THE INVENTION

It is an object of the present invention to provide a lighted tool so that work pieces may be more readily and better worked.

It is an additional embodiment of the present invention to provide a lighted socket wrench extender that illuminates nut or bolt heads to be worked by a socket wrench.

It is yet another embodiment to the present invention to provide an illuminated socket wrench extender that adapts to a socket wrench ratchet.

It is another object of the present invention to provide an illuminating socket wrench extender that provides dispersive light.

It is yet another object of the present invention to provide an illuminating socket wrench extender that provides for focused light which is not dispersive.

These and other objects and advantages of the present invention will be apparent from a review of the following specification and accompanying drawings.

BRIEF DESCRIPTION OF THE DRAWINGS

FIG. 1 also shows an alternative embodiment of the adapter used in the present invention.

DESCRIPTION OF THE PREFERRED EMBODIMENT(S)

Figures 1, 2:
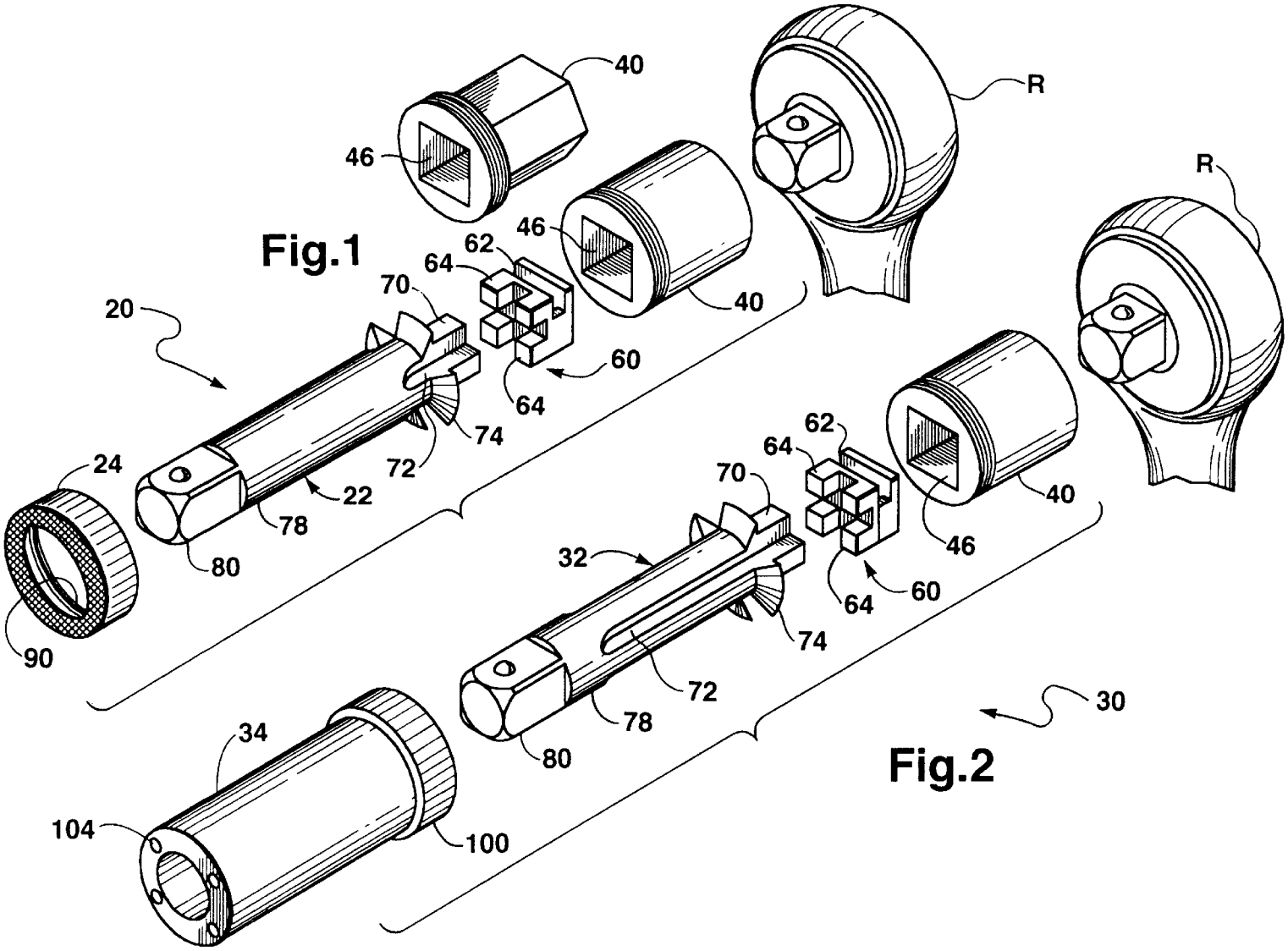
FIG. 1 is an exploded perspective view of a first embodiment of the present invention.
FIG. 2 is an exploded perspective view of an alternative embodiment of the present invention.

While a number of embodiments of the present invention may be achieved through minor alterations, FIGS. 1 and 2 show two primary embodiments of the lighting tool of the present invention. FIG. 1 shows a first embodiment 20 of the present invention having a short-furrowed extender 22 and a shorter sleeve 24. FIG. 2 shows an alternative embodiment 30 having a long furrowed extender 32 and a correspondingly longer sleeve 34.

Figure 7:
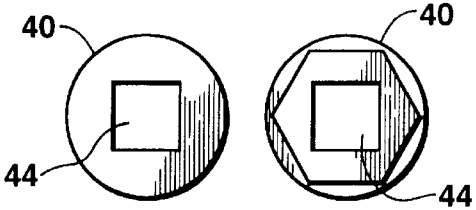
FIG. 7 shows axial plan views of the alternative adapters shown in FIG. 1 taken along line 7—7 of FIG. 3.

Referring now to FIG. 1, a socket wrench head ratchet arm may be fitted with an adapter 40 that may have a circular exterior or, as is shown in FIGS. 1 and 7, a hexagonal exterior engageable by a crescent wrench or other means. The adapter 40 has a ratchet or projection receiving portion 46. Threads 48 or other detachable attachment means are present in the extender end 50 of the adapter 40. Fitting within the light and extender projection socket 46 is a light 60. The light is generally battery powered and may have a battery holding section 62 which provides DC power to the light sources 64 of the light 60. As shown in the figures, the battery holder 62 may be formed by a receptacle between two plates. A spring-biased switch or the like in series with the conduction means may provide the necessary switching contacts between the battery and the light sources 64.

As shown in the drawings, the light 60 has a generally cubicle appearance with the appropriate apertures and the gaps necessary to realize the light 60. At the forward end of the light 60, the individual light sources 64 are formed by four square light sources 64 at corners of a square fitting into the light socket 46 of the adapter 40. The square light sources 64 define between them a cross or plus sign shape that dovetails with a corresponding end of either the short 22 or long 32 furrowed extenders. The light sources may be LED's or other low power light sources to extend the battery life. Alternatively, extended life batteries may be used to power the light sources 64. The light 60 may be made of a translucent plastic or other non-conductor. It may serve to house the light sources in a manner sufficient to realize the present invention.

Turning now to the two embodiments shown of the present invention, FIG. 1 shows a short-furrowed extender 22 while FIG. 2 shows a long-furrowed extender 32. Save for the length of the furrows in each of these extenders, the two extenders are generally similar with corresponding or identical portions referred to herein with corresponding or identical reference numbers.

Figure 5:
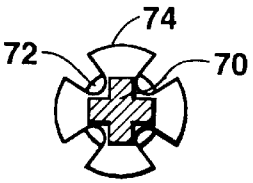
FIG. 5 is an axial plan view of the light-engaging portion of the furrowed extender taken along line 5—5 of FIG. 3.
Figure 6:
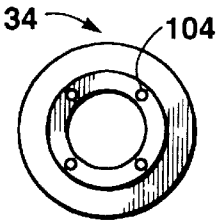
FIG. 6 is an axial plan view of the elongated sleeve of the alternative embodiment of the present invention taken along line 6—6 of FIG. 4.

Beginning first with the short-furrowed extender 22 shown in FIG. 1, the short-furrowed extender 22 has a rearward projection 70 that engages the light 60. As shown in FIG. 5, this rearward extender projection 70 is in the shape of a cross or plus sign. The extender 22 has furrows 72 extending forwardly and laterally along the length of the extender 22 as an extension of the area between the arms of the projection 70. As can be seen in comparison between the extenders of FIG. 1 and FIG. 2, the short-furrowed extender 22 of FIG. 1 has shorter furrows extending a shorter distance along the exterior of the extender 22 than the long-furrowed extender 32. The furrows 72 of the long-furrowed extender 32 extend much farther along the exterior of the extender 32.

Projecting outwardly from the short-furrowed extender 22 are flanges 74. The flanges limit the extent to which the rearward projection 70 can project into the light-receiving portion 46 of the adapter 40. Preferably, the flanges 74 and rearward projection 70 work in concert to seat the light 60 against the rear wall 76 of the light receiving portion 46 of adapter 40. This holds the light 60 in place and prevents injury to it as the present invention is put to use in mechanically and chemically hostile environments.

The rearward extender projection 70 and flanges 74 emanate from the rear of the extender shank 78 within which the furrows 72 are etched, carved, or cast. From the front portion of the shank 78, a socket projection or the like 80 extends forwardly from the shank 78 in a shape similar to that used by the ratchet to engage the adapter 40 at the corresponding receiving portion 44 of adapter 40. Such projections are generally known in the art in engaging sockets in socket wrench set kits.

Figure 3:
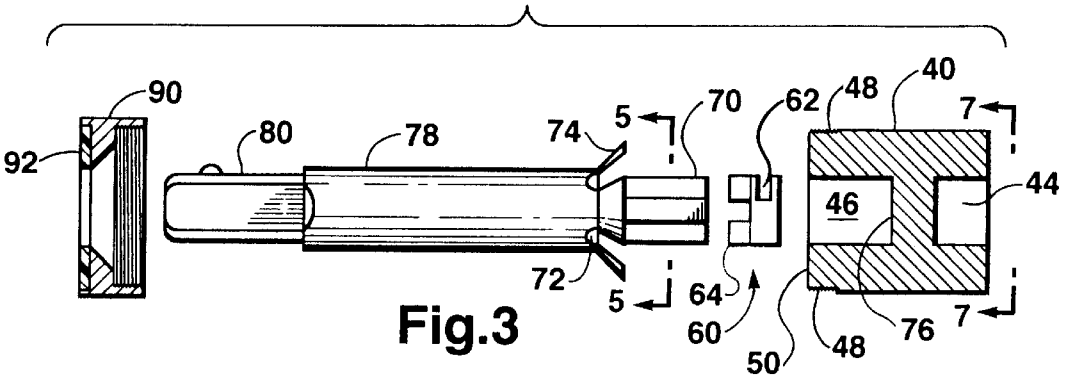
FIG. 3 is a side plan view of the present invention as shown in FIG. 1. The short sleeve and adapter are shown in cross-section.
Figure 4:
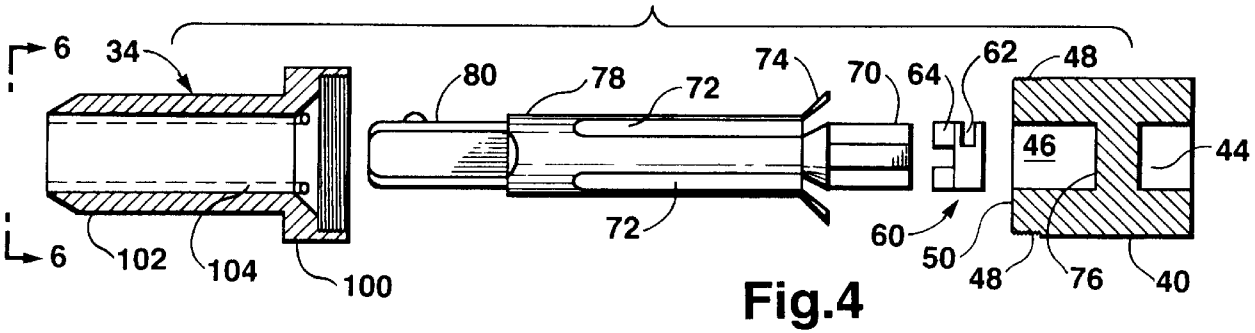
FIG. 4 is a side plan view of the alternative embodiment of the present invention as shown in FIG. 2. The longer sleeve and adapter are shown in cross-section.

FIGS. 1 and 3 show a short sleeve embodiment of the present invention while FIGS. 2 and 4 show a long sleeve embodiment of the present invention.

In FIG. 1, the shorter sleeve 24 has a threaded ring 90 that fits over the short-furrowed extender 22 to engage threads 50 on the adapter 40. The front end of the shorter sleeve 24 is open and covered with a translucent, light dispersing panel 92 through which the shank 78 fits. The panel 92 is toroidal, having an open center through which the shank 78 may pass. Upon being threaded upon the adapter 40 the shorter sleeve 24 entraps the flanges 74 between the translucent light dispersing panel 92 and the front end of the adapter 40. The short-furrowed extender 22 is then held securely upon the adapter 40 by the shorter sleeve 24. Likewise, as the light 60 is trapped between the short-furrowed extender 22 and the adapter 40, the entire construct of shorter sleeve 24, short-furrowed extender 22, light 60, and adapter 40 are held in snug engagement so that play, rattle, or movement between the individual parts is minimized, reduced, or absent.

When fitted with sufficient and appropriate battery power, the light 60 may illuminate the light sources 64 when the sleeve 24 is turned to tighten the shorter sleeves 24 upon the adapter 40. This may serve to sufficiently compress the batteries against a spring or otherwise by a contact, thereby closing the circuit to energize the light sources 64 causing the light 60 to turn on. Detents, small ratchets, or the like may provide tactile means by which the switch may be established and the light 60 turned on and off. Alternatively, an overt switch can be incorporated by known means in the present invention. For example, contacts may lead out from the light 60 to the shorter sleeve 24, thereby providing means by which a switch could be incorporated into the shorter sleeve 24.

As is similarly true for the long-furrowed extender 32 in its longer sleeve 34, the longer sleeve 34 is generally an extended version of the shorter sleeve 24 with an optical channel arrangement allowing the transmission of light along the extender 32. Alternatively, and as shown in FIG. 2, the longer sleeve 34 may incorporate fiber optics or the like to transmit the light from the light sources 64 along the length of the long-furrowed extender 32 and closer to the socket projection 80 at the front end of the shank 78. As shown in FIG. 4, the cross-section of the longer sleeve 34 indicates the use of a threaded ring 100 about which an extending portion 102 projects forwardly therefrom. The threaded ring 100 may be similar to the shorter sleeve 90. The threads of the threaded ring 100 thread upon the threads 48 of the adapter 40 so that the longer sleeve 34 engages the adapter 40 as well as the long-furrowed extender 32 and the light 60 in a manner similar to that as set forth by the shorter sleeve 24, above.

As shown in FIG. 4, the longer sleeve 34 has at least one optic channel that transmits the light from the light sources 64 to the front of the longer sleeve 34. Such optic channels 104 may take the form of optic fibers and the like and serve to prevent dispersion and diminishment of the light transmitted by the light sources 64 as it travels along the optic channels 104.

The optic channels 104 may travel along the longer furrows 72 or may otherwise transmit the light from the illuminating light sources 64 to the front end of the longer sleeve 34. The switching means by which the light 60 may be turned on and off are preferably similar to those as described above for the shorter sleeve 24. However, additional switching methods and constructions may also be advantageously used in conjunction with the present invention.

Figure 8:
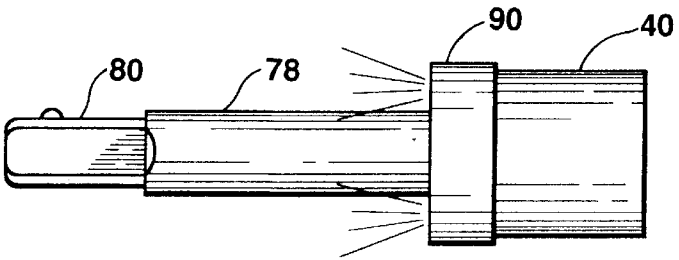
FIG. 8 shows the assembled socket wrench extender of FIG. 1. Illumination of the adjacent area is indicated by the lines emanating from the collar or ring in FIG. 8.

As shown in FIG. 8 with respect to the embodiment shown in FIG. 1, illumination by the lighted tool 20 of the present invention is achieved when the invention is constructed and assembled as set forth above and the light 60 is turned on to project light vis-a-vis translucent light dispersing panel 92 along the shank 78 and front projection 80 of the short-furrowed extender 20. Any socket held on the front projection 80 is likewise illuminated, as is any nut, bolt, or other fastener head to be engaged by the socket or tool at the end of the forward projection 80.

While the present invention has been described with regards to particular embodiments, it is recognized that additional variations of the present invention may be devised without departing from the inventive concept.

What is claimed is:

1. A lighted tool for use in conjunction with socket wrenches comprising:

an adapter, said adapter adapted for fitting upon a socket wrench ratchet and defining a recess within which a plurality of lights fits;

lights, said lights fitting within said light recess;

an extender, said extender having at least four radially spaced furrows extending axially thereof and fitting over said light and extending from said adapter, said extender adapted for engaging tools; whereby light is directed into said furrows of said extender, and illuminates any tool engaging said extender, and an area forward of said extender and said tool so that better engagement and better working of said tool is made upon items to be worked.

2. The lighted tool of claim 1, wherein said adapter further comprises:

said adapter defining a recess for fitting upon said socket wrench ratchet, said socket wrench ratchet recess being oppositely opposed said light recess.

3. The lighted tool of claim 1, which includes a battery holder, said battery holder adapted to be electrically coupled to said lights to provide power thereto, said battery holder fitting within said light recess.

4. The lighted tool of claim 3, wherein said battery holder further comprises:

a compartment, said compartment being adapted to hold at least one battery.

5. The lighted tool of claim 1, wherein said light recess defines a cruciform shaped channel.

6. The lighted tool of claim 5, wherein said extender fits over said lights by fitting within said channel.

7. The lighted tool of claim 6, wherein a flange prevents travel of said extender further into said adapter.

8. The lighted tool of claim 1, wherein said furrows aid transmission of light by said lights.

9. The lighted tool of claim 8, wherein said furrows are short.

10. The lighted tool of claim 8, wherein said furrows are long.

11. The lighted tool of claim 1, further comprising:

a sleeve, said sleeve fitting about said extender and engaging said adapter, said sleeve aiding transmission of light from said lights.

12. The lighted tool of claim 11, wherein said sleeve is short and aids in transmission of light by dispersing light.

13. The lighted tool of claim 12, wherein said short sleeve further comprises a translucent panel, said translucent panel dispersing light.

14. The lighted tool of claim 11, wherein said sleeve is long and aids in transmission of light by focusing or limiting dispersion of said lights.

15. The lighted tool of claim 14, wherein said long sleeve comprises optic channels, said optic channels transmitting light emitted by said lights along said extender.

16. The lighted tool of claim 15, wherein said optic channel further comprises an optic fiber, said optic fiber transmitting light emitted by said lights along said extender.

17. A lighted tool, comprising:

an adapter, said adapter adapted for fitting upon a socket wrench ratchet and defining a recess within which a light may fit, said adapter defining a recess for fitting upon said socket wrench ratchet, said socket wrench ratchet recess oppositely opposed said light recess;

a light, said light fitting within said light recess, said light defining a cruciform shaped channel;

a battery holder, said battery holder adapted to be electrically coupled to said light to provide power thereto, said battery holder fitting within said light recess, said battery holder defining a compartment, said compartment adapted to hold at least one battery;

an extender, said extender fitting over said light and extending from said adapter, said extender fitting over said light by fitting within said cruciform shaped channel, said extender having at least one flange, said flange preventing travel of said extender further into said adapter, said extender defining at least four radially spaced furrows extending axially thereof, said furrows aiding transmission of light by said light, said extender adapted for engaging tools; and a translucent sleeve, said sleeve fitting about said extender and engaging said adapter, said sleeve aiding transmission of light from said light; whereby said light illuminates an area adjacent said extender for better engagement and better working of any tool engaging said extender and items to be worked by said tool.

18. The lighted tool of claim 17, wherein said furrows are short.

19. The lighted tool of claim 17 wherein said furrows are long.

20. The lighted tool of claim 17, wherein said sleeve is short and aids in transmission of light by dispersing light, said sleeve having a translucent panel, said translucent panel dispersing light.

21. The lighted tool of claim 17, wherein said sleeve is long and aids in transmission of light, said sleeve having optic channels, said optic channels transmitting light emitted by said light along said extender.

22. The lighted tool of claim 21, wherein said optic channel further comprises an optic fiber, said optic fiber transmitting light emitted by said light along said extender.

23. A lighted tool, comprising:

an adapter, said adapter adapted for fitting upon a socket wrench ratchet and defining a recess within which a light fits, said adapter defining a recess for fitting upon said socket wrench ratchet, said socket wrench ratchet recess oppositely opposed said light recess;

a light, said light fitting within said light recess, said light defining a cross or plus-sign shaped channel;

a battery holder, said battery holder adapted to be electrically coupled to said light to provide power thereto, said battery holder fitting within said light recess, said battery holder defining a compartment, said compartment adapted to hold at least one battery;

an extender said extender fitting over said light and extending from said adapter, said extender fitting over said light by fitting within said cross or plus-sign shaped channel, said extender having at least one flange, said flange preventing travel of said extender further into said adapter, said extender defining at least one furrow, said furrow adding transmission of light by said light, said extender adapted for engaging tools or the like; and a sleeve, said sleeve being short and having a translucent panel and fitting about said extender and engaging said adapter, said sleeve aiding in dispersing and transmission of light from said light; whereby said light illuminates an area adjacent said extender for better engagement and better working of any tool engaging said extender and items to be worked by said tool.

24. A lighted tool for use in conjunction with socket wrenches, the lighted tool comprising:

an adapter, said adapter adapted for fitting upon a socket wrench ratchet and defining a recess within which a light fits;

a light, said light fitting within said light recess;

an extender, said extender fitting over said light and extending from said adapter, a sleeve, said sleeve being short and comprising a translucent panel and fitting about said extender and engaging said adapter, said sleeve aiding dispersing and transmission of light from said light, said extender adapted for engaging tools; whereby said light illuminates said extender, any tool engaging said extender and an area forward of said extender and said tool so that better engagement and better working of said tool may be made upon items to be worked.

* * * * *